US005531168A

United States Patent [19]

Towfigh

[11] Patent Number: 5,531,168

[45] Date of Patent: Jul. 2, 1996

[54] ADJUSTABLE TABLE AND SHELF UNIT

[75] Inventor: Keivan Towfigh, Millis, Mass.

[73] Assignee: Soho, Inc., Boston, Mass.

[21] Appl. No.: 278,604

[22] Filed: Jul. 21, 1994

[51] Int. Cl.[6] ..... A47B 9/00

[52] U.S. Cl. ..... 108/108; 248/244

[58] Field of Search ..... 108/106, 107, 108/108, 109, 110, 152, 159, 144; 248/235, 243, 244, 245; 211/107, 153

[56] References Cited

U.S. PATENT DOCUMENTS

| | | | |
|---|---|---|---|
| 919,526 | 4/1909 | Belcher | 108/108 |
| 1,041,264 | 10/1912 | Freud . | |
| 2,335,896 | 12/1943 | Anderson . | |
| 3,088,424 | 5/1963 | Knuth . | |
| 3,207,100 | 9/1965 | Peacock | 108/108 X |
| 3,664,627 | 5/1972 | Sykes . | |
| 3,710,096 | 1/1973 | McFarlin . | |
| 3,847,489 | 11/1974 | Van Riper . | |
| 3,865,337 | 2/1975 | Towfigh et al. . | |
| 4,103,855 | 8/1978 | Grosse | 108/108 X |
| 4,156,515 | 5/1979 | Mochly . | |
| 4,299,368 | 11/1981 | Winkler | 108/108 X |
| 4,365,561 | 12/1982 | Tellier et al. . | |
| 4,421,289 | 12/1983 | Sturm . | |
| 4,498,204 | 2/1985 | Warner . | |
| 4,568,050 | 2/1986 | Radoy et al. . | |
| 4,616,218 | 10/1986 | Bailey et al. . | |
| 4,690,362 | 9/1987 | Helgeland . | |
| 4,895,331 | 1/1990 | Nehls | 108/108 X |
| 5,048,784 | 9/1991 | Schwartz et al. . | |
| 5,135,190 | 8/1992 | Wilson . | |
| 5,209,446 | 5/1993 | Kawai . | |

FOREIGN PATENT DOCUMENTS

| | | | |
|---|---|---|---|
| 523862 | 4/1956 | Canada . | |
| 782416 | 4/1968 | Canada | 108/108 |
| 835777 | 3/1970 | Canada . | |
| 825044 | 11/1951 | Germany . | |
| 371873 | 10/1963 | Switzerland . | |

OTHER PUBLICATIONS

Rangine Corporation, 114 Union Street, Millis, MA 02054, Rakks (Electronic Furniture Systems), Space Management Systems, Series 211, Copyright 1983.

*Primary Examiner*—Jose V. Chen

*Attorney, Agent, or Firm*—Testa, Hurwitz & Thibeault

[57] ABSTRACT

An adjustable shelf unit includes a pair of parallel, vertical stanchions each defining a vertical channel. A pair of adjustable braces each has horizontal support surfaces and a proximal end slidably retained in a respective front channel. A locking means is coupled to the proximal end of the braces for releasably securing the braces at a freely selectable elevation in the front channels. A planar element, such as a shelf, is disposed above the braces slidably coupled to the stanchions such that the horizontal surfaces of the braces support the first planar element for load bearing. The horizontal surfaces of the braces remain horizontally disposed as the braces are moved to a freely selectable elevation in the front channels.

9 Claims, 6 Drawing Sheets

ADJUSTABLE TABLE AND SHELF UNIT

BACKGROUND OF THE INVENTION

The invention relates generally to adjustable shelf units typically used to provide workspace and storage space for electronic equipment. In particular, the invention concerns adjustable shelf units which include at least one shelf supported by adjustable braces having horizontal support surfaces that remain horizontally disposed as the braces are moved to freely selectable elevations.

Known shelving structures typically include braces coupled to vertical stanchions for supporting shelves. These known shelving structures vary widely in terms of ease and extent of adjustability of the shelves. For example, one group of known shelving structures requires tools and special fastening devices to secure the braces to the stanchions. Another group of such structures has limited shelf adjustability in that the adjustable support braces can only be positioned at fixed locations along the vertical stanchions.

Another example of known shelving structures is provided in U.S. Pat. No. 3,865,337. The disclosed structure includes slotted vertical stanchions in which braces are positioned. The braces have a cantilevered end adapted to support a shelf and a connective end for locking the brace into a position. This structure, while freely adjustable, requires a complicated procedure to adjust the position of each shelf. A shelf to be adjusted must first be cleared of any equipment located thereon. Next, the shelf (and underlying brace) must be rotated upwardly to release the locking mechanism at the connective end of the brace. Once these two steps have been performed, the shelf (and brace) can be moved to a different position.

It is an object of the invention, therefore, to provide a shelf unit with shelves which are easily adjustable to an unlimited range of elevations. Another object of the invention is to provide such a shelf unit which can be easily and cost-effectively manufactured.

SUMMARY OF THE INVENTION

These and other objects are achieved by the present invention which features an adjustable shelf unit for providing workspace and storage space for electronic equipment. More specifically, the invention concerns easily adjustable shelf units which include at least one shelf supported by adjustable braces having horizontal support surfaces that remain horizontally disposed as the braces are moved to freely selectable elevations.

In one embodiment, the adjustable shelf unit comprises a pair of vertical stanchions arranged parallel to each other. Each of the stanchions is configured to define a front vertical channel. Supports are coupled to the stanchions for supporting the stanchions vertically. These supports can include horizontal members each coupled to one end of a respective stanchion.

The shelf unit further comprises a first pair of braces each having a proximal end and defining a horizontal surface. The proximal end of each brace is slidably retained in one of the front channels defined by the stanchions. A locking means is coupled to the proximal end of the braces for releasably securing the braces at a freely selectable elevation in the front channels.

A first planar element, such as a shelf, is disposed above the braces slidably coupled to the stanchions such that the horizontal surfaces of the braces support the first planar element for load bearing. In accordance with the invention, these horizontal surfaces remain horizontally disposed as the braces are moved to a freely selectable elevation in the front channels.

In another embodiment, the shelf unit is configured so that the first planar element is positionable at an angle to the horizontal. To accomplish this, the first planar element coupled to the stanchions via a pair of pins. Each pin is rotatably attached to a guide block slidably retained in one of the front vertical channels. The guide blocks are secured in the front channels at an elevation above the horizontal surfaces of the braces such that the first planar element is supported by the horizontal surfaces at an angle to horizontal.

In yet another embodiment, the adjustable shelf unit includes a second pair of braces each having a proximal end and defining a horizontal surface. The proximal ends of these braces are slidably retained, one each, in rear vertical channels defined by the stanchions. A locking means is coupled to the proximal end of the second pair of braces for releasably securing the second pair of braces at a freely selectable elevation in the rear channels. A second planar element, such as a shelf, is slidably coupled to the stanchions above the second pair of braces such that the horizontal surfaces support the second planar element for load bearing. In accordance with the invention, the horizontal surfaces remain horizontally disposed as the second pair of braces are moved to a freely selectable elevation in the rear channels.

To provide additional shelving space, it is noted that additional braces and planar elements can be added to the adjustable shelf unit without departing from the scope of the invention.

An advantage of the invention is that no tools or complicated procedures are required to adjust elevation of the various shelves of the unit. Rather, this adjustment can be easily performed by simply manipulating the locking means and braces. More specifically, the locking means are manipulated to loosen the proximal ends of the braces supporting a particular shelf. The braces are then simply moved in the tracks of the vertical channels to a selected elevation. Significantly, the horizontal support surfaces of the braces remain horizontally disposed as the braces are moved in the tracks. Consequently, the shelf need not be cleared of any equipment or rotated in any manner to be moved to the selected elevation.

These and other features of the invention will be more fully appreciated by reference to the following detailed description which is to be read in conjunction with the attached drawings.

BRIEF DESCRIPTION OF THE DRAWINGS

The foregoing and other objects, features and advantages of the invention will become apparent from the following more particular description of preferred embodiments of the invention, as illustrated in the accompanying drawings. The drawings are not necessarily to scale, emphasis instead being placed on illustrating the principles of the present invention.

DETAILED DESCRIPTION

As stated, the present invention concerns an easily adjustable shelf unit which include at least one shelf supported by adjustable braces having horizontal support surfaces that remain horizontally disposed as the braces are moved to freely selectable elevations.

Figure 1:
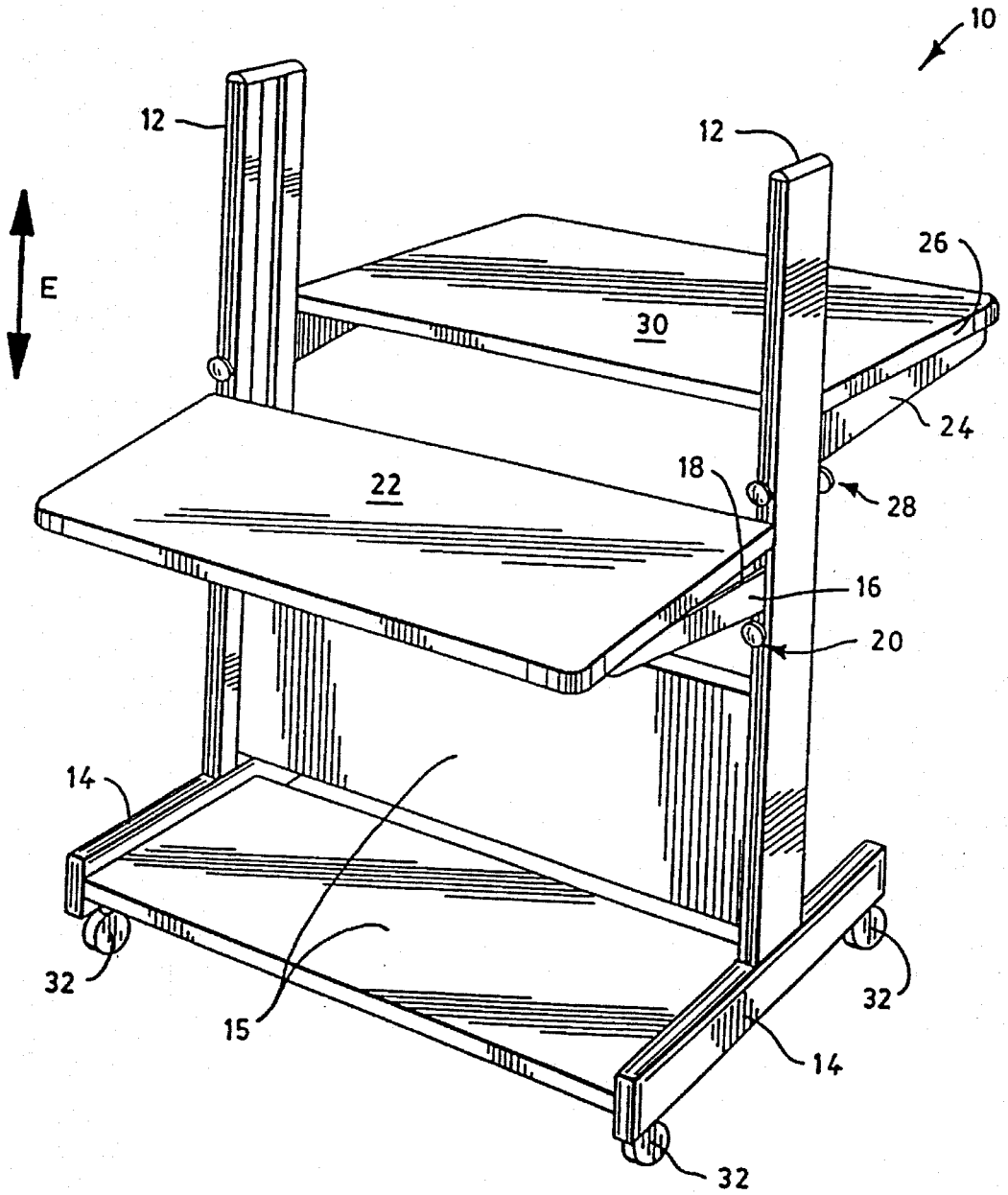
FIG. 1 is a perspective view of an inventive adjustable shelf unit.
Figure 2:
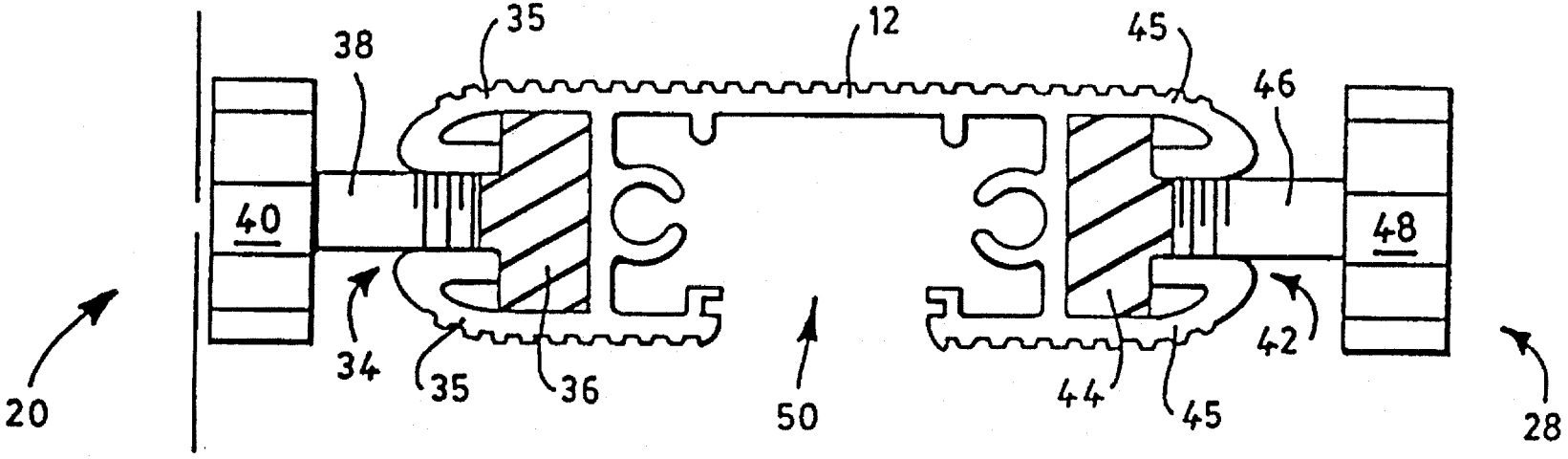
FIG. 2 is a top view of a stanchion and locking means used in an inventive adjustable shelf unit

One embodiment of the present invention is shown in FIG. 1, which is a perspective view of an inventive adjustable shelf unit. The unit 10 comprises a pair of vertical stanchions 12 arranged parallel to each other. Each of the stanchions 12 is configured to define a front vertical channel 34 (FIG. 2). Horizontal supports 14 and supporting panels 15 are coupled to the stanchions 12 to support the stanchions vertically and to provide overall stability to the unit 10. The horizontal supports 14 are each coupled via bolts or some other mechanism to one end of a respective stanchion 12. Castors 32 may be coupled to the horizontal supports 14 so that the unit 10 can be easily moved. The planar supports 15 each are positioned between stanchions 12 and the horizontal supports 14.

A pair of braces 16 each has a proximal end 36 (FIG. 3) and defines a horizontal surface 18. The proximal end of each brace 16 is slidably retained in one of the front channels of the stanchions 12. A locking means 20 is coupled to the proximal end of the braces 16 for releasably securing the braces at a freely selectable elevation (E) in the front channels. A planar element 22, such as a shelf, is disposed above the braces 16. The planar element 22 is slidably coupled to the stanchions 12 such that the horizontal surfaces 18 of the braces 16 support the planar element 22 for load bearing.

In the illustrated embodiment, the planar element 22 is adjustably secured relative to the braces 16 via movable dowels 17. The dowels 17 are pivotably fixed to the braces 16 by pins 19 about which the dowels may rotate. The braces 16 define channels C which enable rotation of the dowels 17. The dowels 17 are received by the planar elements 22 in mating recesses 21. The dowels 17 and recesses 21 are configured so that their interrelation does not interfere with the tilting of the planar element 22 as described below.

An adjustment of the elevation of the planar element 22 can be easily performed by simply manipulating the locking means 20 and braces 18. First, the locking means 20 are manipulated to loosen the proximal ends of the braces 16. The braces are then simply moved in the vertical channels to a selected elevation (E). In accordance with the invention, the horizontal support surfaces 18 of the braces 16 remain horizontally disposed as the braces are moved in the channels. Consequently, the planar element 22 need not be cleared of any equipment or rotated in any manner to be moved to the selected elevation.

The unit 10, as shown, can be configured to include a second planar element 26 so as to provide additional shelving space. Accordingly, the unit 10 includes a second pair of braces 24 each having a proximal end 44 (FIG. 2) and defining a horizontal surface 26. The proximal ends of these braces 24 are slidably retained, one each, in rear vertical channels 42 (FIG. 2) defined by the stanchions 12. A locking means 28 is coupled to the proximal end of the second pair of braces 24 for releasably securing the second pair of braces at a freely selectable elevation (E) in the rear channels. The second planar element, which may be a shelf, is slidably coupled to the stanchions 12 above the second pair of braces 24 such that the horizontal surfaces 26 support the second planar element for load bearing. The horizontal surfaces 26 remain horizontally disposed as the second pair of braces 24 are moved to a freely selectable elevation in the rear channels.

FIG. 2 is a top view of a stanchion 12 and locking apparatus 20, 28 used in the adjustable shelf unit 10. The horizontal supports 14 are configured similarly and, accordingly, are not described separately in great detail. The stanchion 12 is formed into its rather intricate shape by an extrusion process. The stanchion 12 defines a channel 50 for receiving a supporting panel 15 as described in greater detail below. The stanchion also includes flanges 35, 45 which, in part, define the front channel 34 and the rear channel 42 respectively. The stanchion further includes guides 51 for receiving a strip or panel 53 for concealing otherwise exposed portions of the channel 50.

The locking apparatus 20 secures the proximal end 36 of each brace 16 (FIG. 1) in the front channel 34. In the illustrated embodiment, the apparatus 20 includes a threaded bolt 37 fixed to the proximal end 36 of the brace and a knob 40 defining a threaded bore (not shown) for engaging the bolt 38. Rotating the knob 40 clock-wise draws the knob 40 toward the flanges 45 and once the knob 40 contacts the flanges 35, generates compressive force between the knob 40 and the proximal end 36 of the brace 16. The compressive force can be increased or decreased to effect, respectively, locking or release of the brace 1*b* to the flanges 35.

The locking apparatus 28 secures the proximal end 44 of each brace 24 (FIG. 1) in the rear channel 42. The apparatus 28 includes a threaded bolt 46 fixed to the proximal end 44 of the brace and a knob 48 defining a threaded bore (not shown) for engaging the bolt 46. The knob 48, bolt 46, and proximal end 44 cooperate, as described with respect to brace 16, for creating a compressive force on flanges 45 to lock the braces 24 relative to the stanchions 12.

Figure 4:
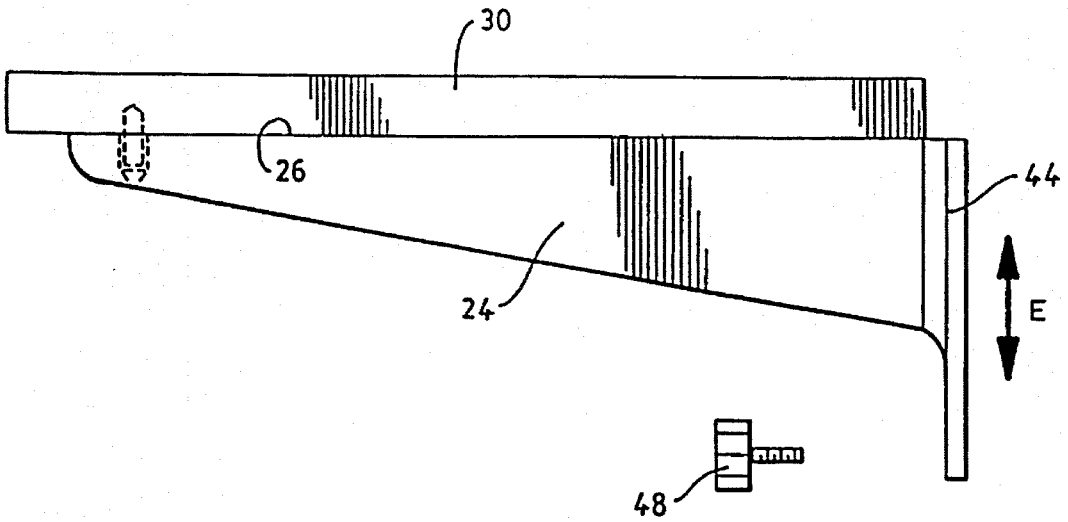
FIG. 4 is a cross-sectional view of a planar element configured to be positionable at angles to the horizontal in an inventive adjustable shelf unit.

FIG. 4 is a side elevation view of one of a pair of braces 24 used in the adjustable shelf unit 10. As shown, the brace 24 has a proximal end 44 and defines a horizontal surface 26. The planar element 30 is positioned on or above each brace 24 so that the horizontal surfaces 26 of the braces 24 support the planar element 30 for load bearing. The knob 48 can be twisted for loosening the braces 24, thereby enabling adjustment of the elevation of the planar element 30. The braces 24 are then simply moved in the vertical channels (FIG. 2) to another elevation. As noted previously, the horizontal support surfaces 26 of each brace 24 remain horizontally disposed as the braces are moved in the channels.

Figure 3:
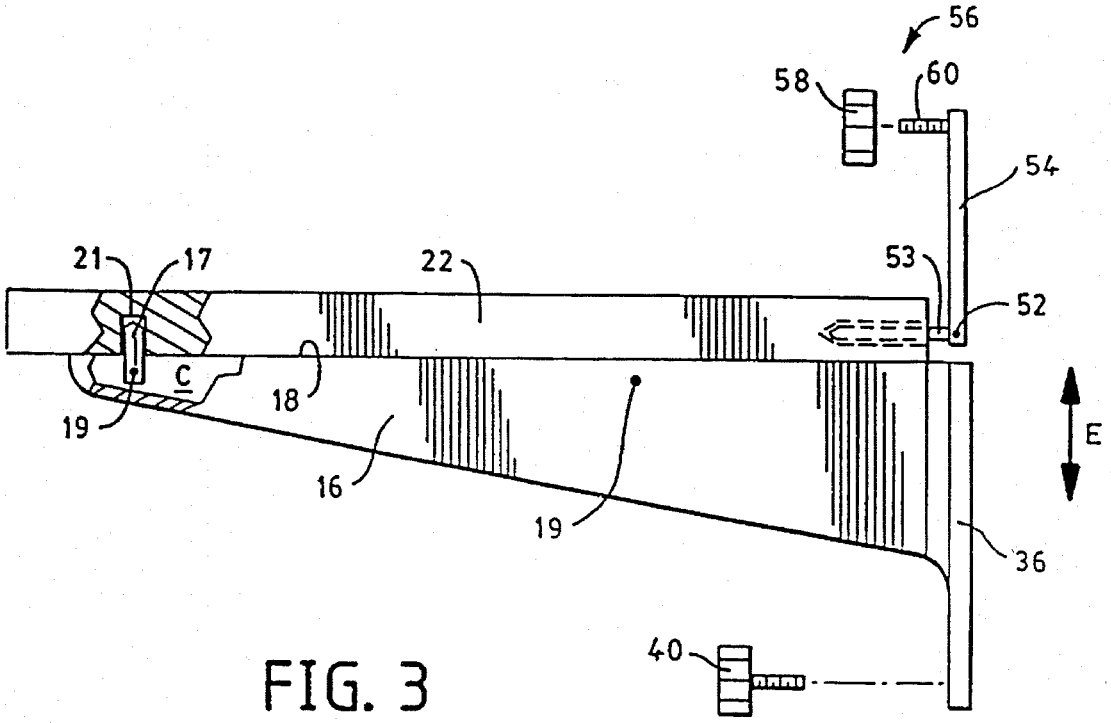
FIG. 3 is a cross-sectional view of a brace used in an inventive adjustable shelf unit.

FIG. 3 is a partial cross-sectional view of the planar element 22 configured to be positionable at angles to the horizontal in the inventive adjustable shelf unit 10. The first planar element 22 is coupled to the stanchions 12 (FIG. 1) via a pair of pins 52. Each pin 52 is rotatably attached by a tubing member 53 to a yoke 54 slidably retained in one of the front vertical channels 34 (FIG. 2). The yokes 54 are secured in the front channels at an elevation above the horizontal surfaces 18 of the braces by a locking means 56. The locking means 56 includes a knob 58 and a threaded bolt 60.

To position the planar element 22 at angle to the horizontal, each knob 58 is twisted to loosen the yokes 54 in the channels. The yokes are then moved in the channels to an elevation above the horizontal surfaces 18 such that the planar element 22 is supported by the horizontal surfaces at an angle to horizontal. This angle is preferably between about one to about thirty degrees. To move the planar element 22 to a selected elevation, both sets of knobs 40, 58 must be loosened. The yokes 54 and the braces 16 are then moved in the vertical channels to another elevation. The knobs 40 are then tightened to secure the braces 16 and the planar element 22 at the selected elevation.

Figures 5A, 5F:
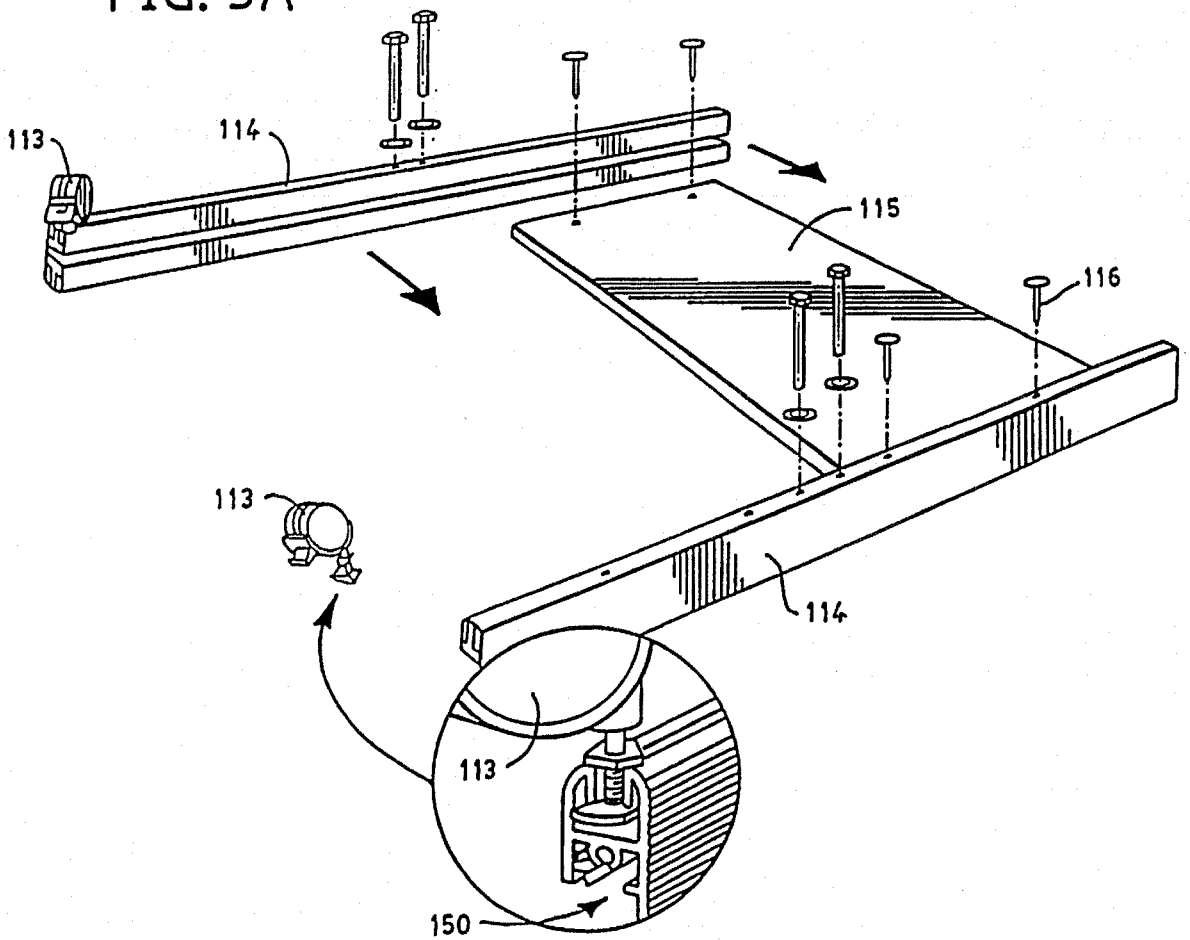
FIGS. 5A through 5F are perspective, partially exploded views of an inventive adjustable shelf unit in various stages of assembly

Another significant advantage to the invention is the ease with which the unit 10 can be assembled and dissassembled. FIGS. 5A through 5F show an adjustable table and shelf unit 110 constructed in accordance with the teachings of the present invention, in various stages of assembly. For example, as shown in FIG. 5A horizontal supports 114 are secured to supporting panels 115 via screws 116 or some similar mechanism. The horizontal supports 114 are formed to define channels 150 for receiving opposed edges of the support panel 115 as clearly visible in FIG. 5C. Casters 113 can be coupled to the horizontal supports 114 via channels defined in the support (see exploded view of FIG. 5A).

Figure 5C:
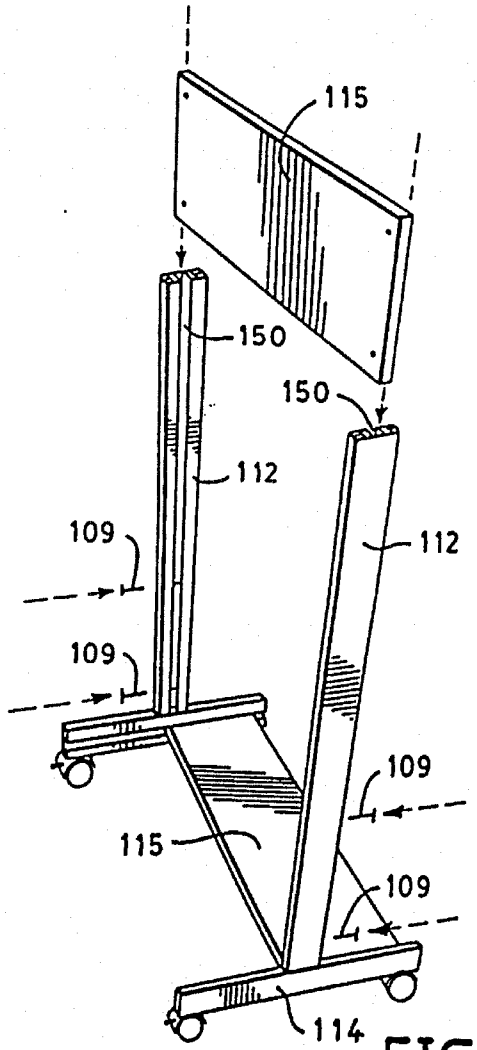
Figure 5B:
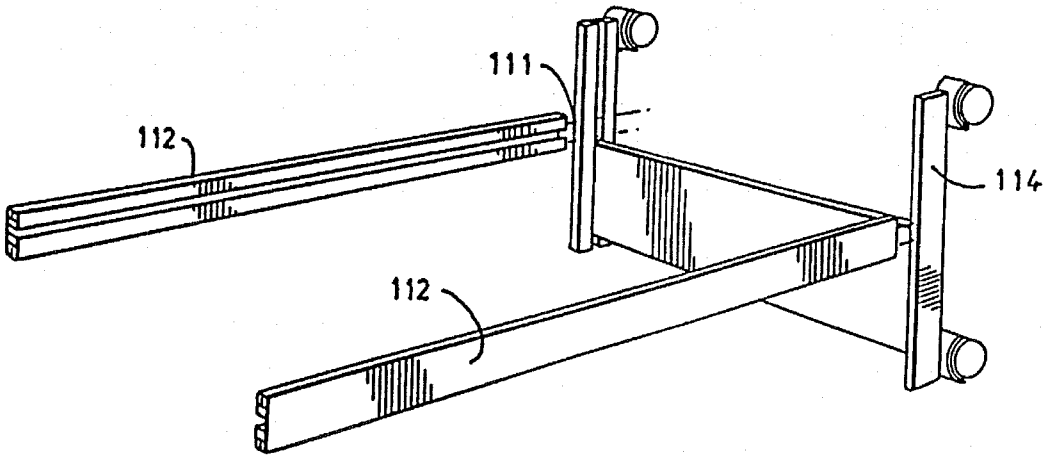

FIG. 5B shows attachment of vertical stanchions 112 to the horizontal supports 114 via bolts 111, or some similar mechanism. In FIG. 5C, there is shown that an additional supporting panel 115 may be interfit in the channels 150 defined by the vertical stanchions 112 and attached thereto via screws 109, or the like. This unique interrelationship of the supporting panels 115 and the channels 150 defined by the horizontal supports 114 and vertical stanchions 112 provides an extremely stable structure which is simple to assemble.

Figure 5E:
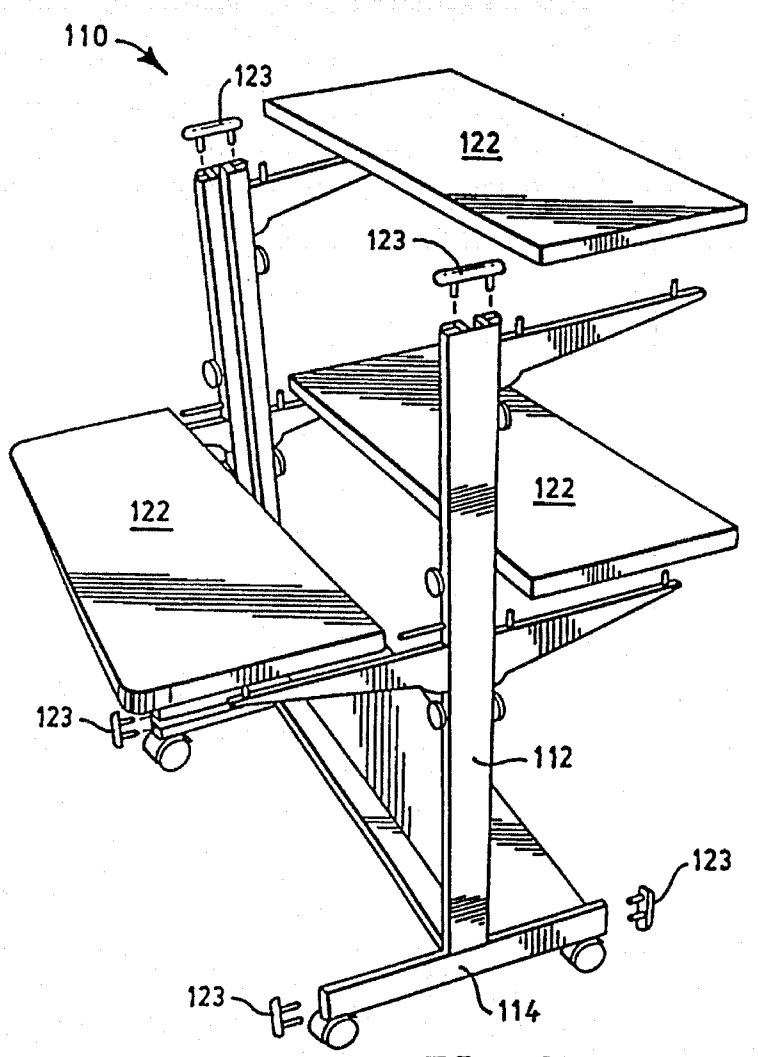
Figure 5D:
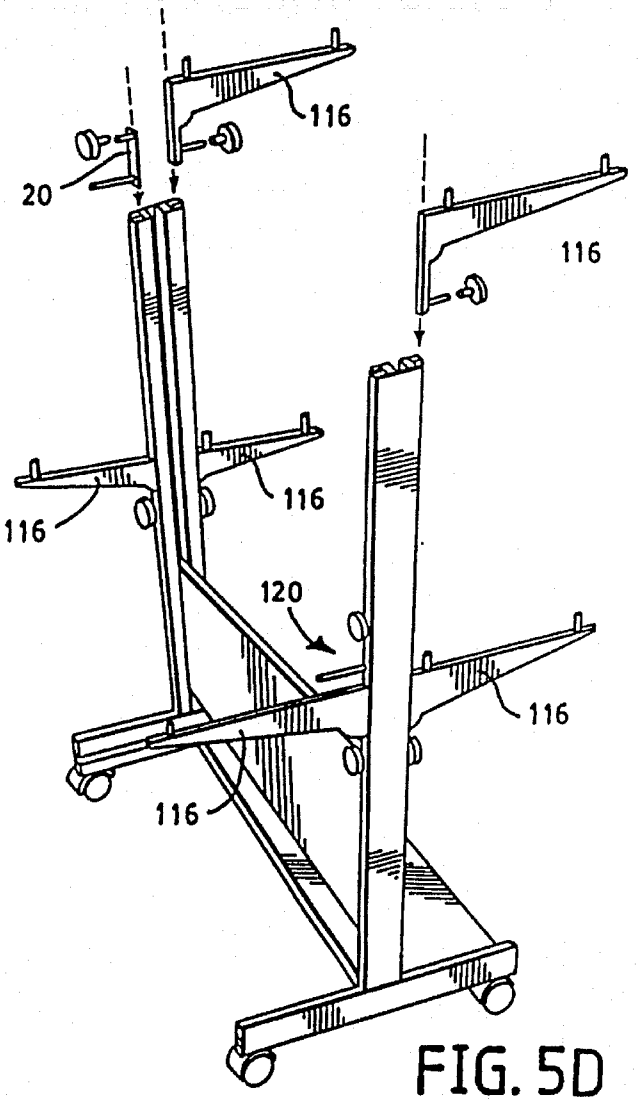

FIG. 5D portrays the assembly of braces 116 and yokes 120 to the vertical stanchions 112 for supporting an arrangement of planar elements 122, as shown in FIG. 5E. As a final assembly step, end caps 123 may be placed in the ends of vertical stanchions 112 and horizontal supports 114.

While various embodiments of the invention have been set forth in detail, it should be understood that the above description is intended as illustrative rather than limiting and that many variations to the described embodiments will be apparent to those skilled in the art. The invention is to be defined, therefore, not by the preceding description, but by the claims that follow.

What is claimed is:

1. An adjustable shelf unit comprising:

a pair of stanchions arranged parallel to one another, each of the stanchions defining a front vertical channel;

supports coupled to the stanchions for supporting the stanchions vertically;

a first pair of braces slidably retained in the front channels and defining horizontal surfaces, each of the braces having a proximal end configured for retention in one of the front channels while permitting displacement along said one front channel;

locking means coupled to the proximal end of the braces for releasably securing the braces at a freely selectable elevation in the front channels; and a first planar element slidably coupled to the stanchions above the braces such that the horizontal surfaces support the first planar element for load bearing, the horizontal surfaces being capable of remaining substantially horizontally disposed as the braces are moved to a freely selectable elevation in the front channels.

2. A unit as set forth in claim 1 wherein the stanchions further define rear vertical channels and the unit further comprises:

a second pair of braces slidably retained in the front channels and defining horizontal surfaces, each of the second pair of braces having a proximal end configured for retention in one of rear channel's while permitting displacement along said one rear channel;

locking means coupled to the proximal end of the second pair of braces for releasably securing the second pair of braces at a freely selectable elevation in the rear channels; and a second planar element slidably coupled to the stanchions above the second pair of braces such that the horizontal surfaces of the second pair of braces support the second planar element for load bearing, the horizontal surfaces of the second pair of braces being capable of remaining substantially horizontally disposed as the second pair of braces are moved to a freely selectable elevation in the rear channels.

3. A unit as set forth in claim 1 wherein the first planar element is coupled to the stanchions via a pair of pins each of which is rotatably attached to a guide block slidably retained in one of the front vertical channels.

4. A unit as set forth in claim 3 wherein the guide blocks are secured in the front channels at an elevation above the horizontal surfaces of the braces such that the first planar element is supported by the horizontal surfaces at an angle to horizontal.

5. A unit as set forth in claim 4 wherein the angle is between approximately 1° and approximately 30°.

6. A unit as set forth in claim 1 wherein each of the front vertical channels of the stanchions is defined, in part, by flanges and the locking means securing each of the proximal ends of the braces comprises:

a threaded bolt fixed to the proximal end of the brace;

a knob defining a threaded bore for receiving the threaded bolt whereby rotation of the knob translates to a compressive force between the knob and the proximal end of the brace for releasably locking the brace to the flanges.

7. A unit as set forth in claim 1 further comprising dowels rotably secured to the braces and wherein the planar element defines recesses for receiving the dowels for securing the planar element relative to the braces.

8. A unit as set forth in claim 1 wherein the stanchions further define inwardly facing channels and the unit further comprises a supporting panel having parallel edges interfitting and secured within the inwardly facing channels.

9. A unit as set forth in claim 1 wherein the supports define a second set of inwardly facing channels and the unit further comprises a second supporting panel having parallel edges interfitting and secured within the second set of inwardly facing channels.

* * * * *